US006862004B2

(12) United States Patent
Alexopoulos et al.

(10) Patent No.: US 6,862,004 B2
(45) Date of Patent: Mar. 1, 2005

(54) ECCENTRIC SPIRAL ANTENNA AND METHOD FOR MAKING SAME

(75) Inventors: Nicolaos G. Alexopoulos, Irvine, CA (US); Franco De Flaviis, Irvine, CA (US); Jesus Alfonso Castaneda, Los Angeles, CA (US)

(73) Assignee: Broadcom Corporation, Irvine, CA (US)

( * ) Notice: Subject to any disclaimer, the term of this patent is extended or adjusted under 35 U.S.C. 154(b) by 0 days.

(21) Appl. No.: 10/359,140

(22) Filed: Feb. 6, 2003

(65) Prior Publication Data

US 2004/0113862 A1 Jun. 17, 2004

Related U.S. Application Data

(60) Provisional application No. 60/433,000, filed on Dec. 13, 2002.

(51) Int. Cl.[7] ..... H01Q 1/36
(52) U.S. Cl. ..... 343/895; 343/876
(58) Field of Search ..... 343/895, 757, 343/700 MS, 876; H01Q 1/36

(56) References Cited

U.S. PATENT DOCUMENTS

| | | | | | |
|---|---|---|---|---|---|
| 3,530,486 | A | * | 9/1970 | Strider | 343/895 |
| 4,559,539 | A | * | 12/1985 | Markowitz et al. | 343/725 |
| 5,227,807 | A | * | 7/1993 | Bohlman et al. | 343/895 |
| 6,023,250 | A | * | 2/2000 | Cronyn | 343/895 |
| 6,300,918 | B1 | * | 10/2001 | Riddle et al. | 343/895 |

* cited by examiner

*Primary Examiner*—Hoanganh Le
(74) *Attorney, Agent, or Firm*—Sterne, Kessler, Goldstein & Fox P.L.L.C.

(57) ABSTRACT

A system includes a support device and an elongated spiral antenna coupled to the support device. The elongated spiral antenna has a contracted portion and an expanded portion. The expanded portion provides beam steering and directivity. The system also includes a feed line coupled to the elongated spiral antenna. A method for forming the elongated spiral antenna uses a predetermined formula to form arms of the elongated spiral antenna. The arms can be formed by printing the arms on a printed circuit board.

41 Claims, 19 Drawing Sheets

POLAR ELEVATION PATTERN

ECCENTRIC SPIRAL ANTENNA AND METHOD FOR MAKING SAME

CROSS REFERENCE TO RELATED APPLICATIONS

This application claims benefit under 35 U.S.C. § 119(e) to U.S. Provisional Patent Application No. 60/433,000, filed Dec. 13, 2002.

BACKGROUND OF THE INVENTION

1. Field of the Invention

The present invention is related to antennas positioned in compact environments that transmit and receive electromagnetic beams ("beams") to and from various directions.

2. Background Art

Traditionally, in order to receive or transmit beams to or in various directions an operator would either have to mechanically or manually move an antenna or build a large antenna array. These are costly in both time and materials. Also, as telecommunications devices become smaller and more mobile, these antennas cannot be configured to both be more compact and deliver the required functionality.

Therefore, a need exists for a small antenna that is capable of being positioned in a mobile communications device, which also allows for transmission and reception of beams to and from various directions without requiring mechanical or manual moving of the antenna.

BRIEF SUMMARY OF THE INVENTION

An embodiment of the present invention provides a system including a support device and an elongated spiral antenna coupled to the support device. The elongated spiral antenna has a contracted portion and an expanded portion. The expanded portion provides bean steering and directivity. The system also includes a feed line coupled to the elongated spiral antenna.

Another embodiment of the present invention provides an elongated spiral antenna including a coupler, a first spiral portion coupled to the coupler, and a second spiral portion coupled to the coupler. The first and second spiral portions are spaced from each other and include a contracted section and an expanded section. The expanded section can be used for beam steering and directivity.

A still further embodiment of the present invention provides a method including spacing spiral portions of an elongated spiral antenna a first predetermined distance from each other in a contracted section. The method also includes spacing the spiral portions of the elongated spiral antenna a second predetermined distance from each other in an expanded section. The first predetermined distance is less than and can be proportional to the second predetermined distance. Beam steering and directivity are based on the spacing of the second predetermined distance.

Further embodiments, features, and advantages of the present invention, as well as the structure and operation of the various embodiments of the present invention, are described in detail below with reference to the accompanying drawings.

BRIEF DESCRIPTION OF THE DRAWINGS/ FIGURES

The accompanying drawings, which are incorporated herein and form a part of the specification, illustrate the present invention and, together with the description, further serve to explain the principles of the invention and to enable a person skilled in the pertinent art to make and use the invention.

Figure 1:
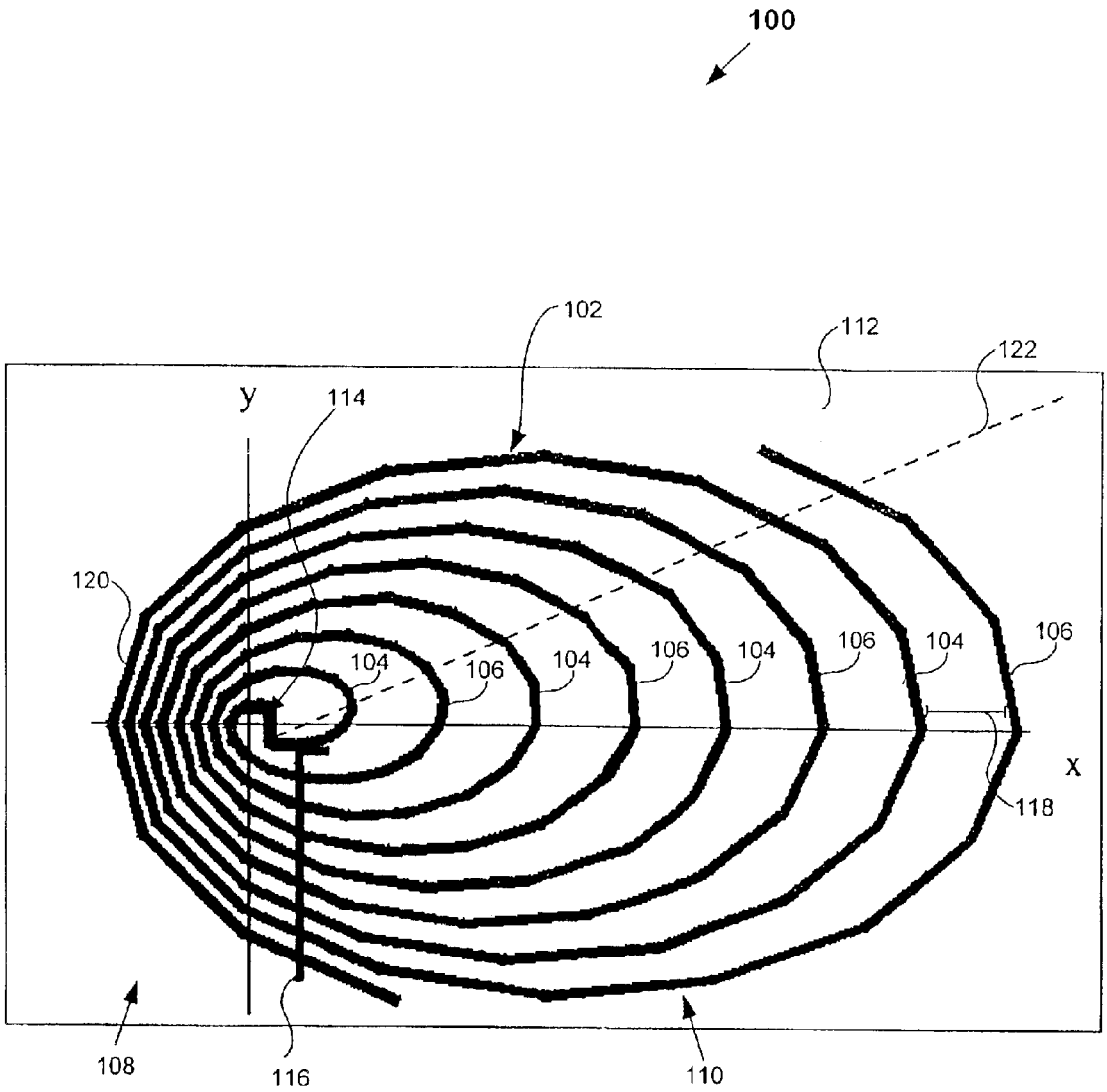
FIG. 1 shows an elongated spiral antenna according to embodiments of the present invention.

The present invention will now be described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF THE INVENTION

Elongated Spiral Antenna

Figure 2:
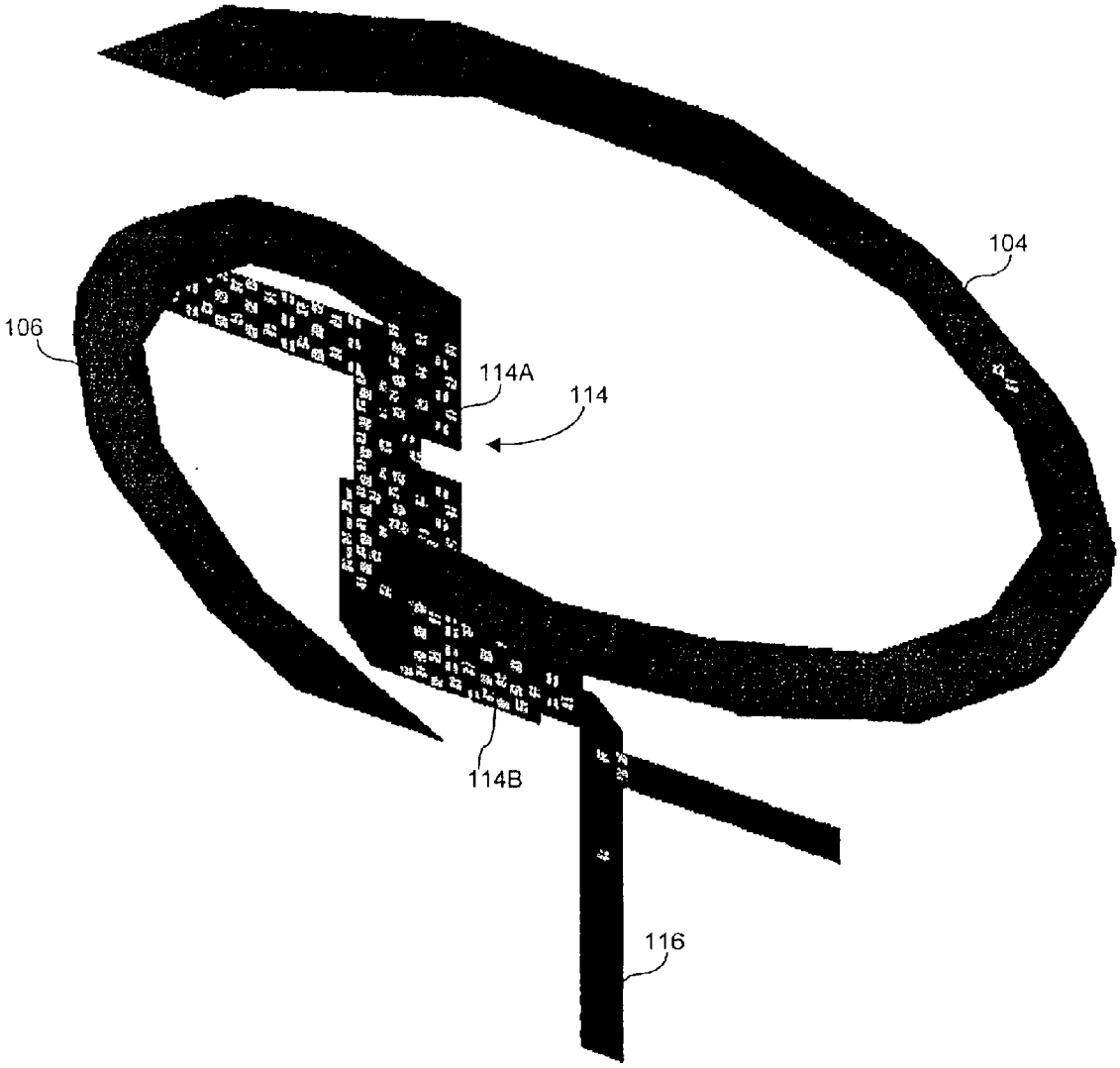
FIG. 2 shows a tuning stub of a feed line to an elongated spiral antenna according to embodiments of the present invention.

FIGS. 1–2 show a system 100 that includes an elongated spiral antenna 102 according to embodiments of the present invention. Elongated refers to antenna 102 being more expanded or stretched along an X-axis. Antenna 102 includes first 104 and second 106 spiral portions or arms (hereinafter, both are referred to as arms). It is to be appreciated, more or fewer arms can be used without departing from the scope of the invention. In the example shown, each arm 104, 106 has four turns, which form a contracted portion 108 and an expanded portion 110 of antenna 102. The distance 118 between adjacent arms 114, 116 in the expanded portion 110 is greater than the corresponding distance 120 in the contracted portion 108. It is to be appreciated any number of turns can be used, as is discussed below.

As best seen in FIG. 2, coupler 114 transmits an output signal from feed line 116 to antenna 102. Likewise, coupler 114 receives an input signal from antenna 102. It is to be appreciated that any type of signal input and/or output system can be used to feed signals to or receive signals from antenna 102, as is known in the art. The coupler 114 can include first and second sections 114A and 114B, which can be located on two difference layers of a substrate 1702 (see FIG. 17 and related description below).

Figure 3:
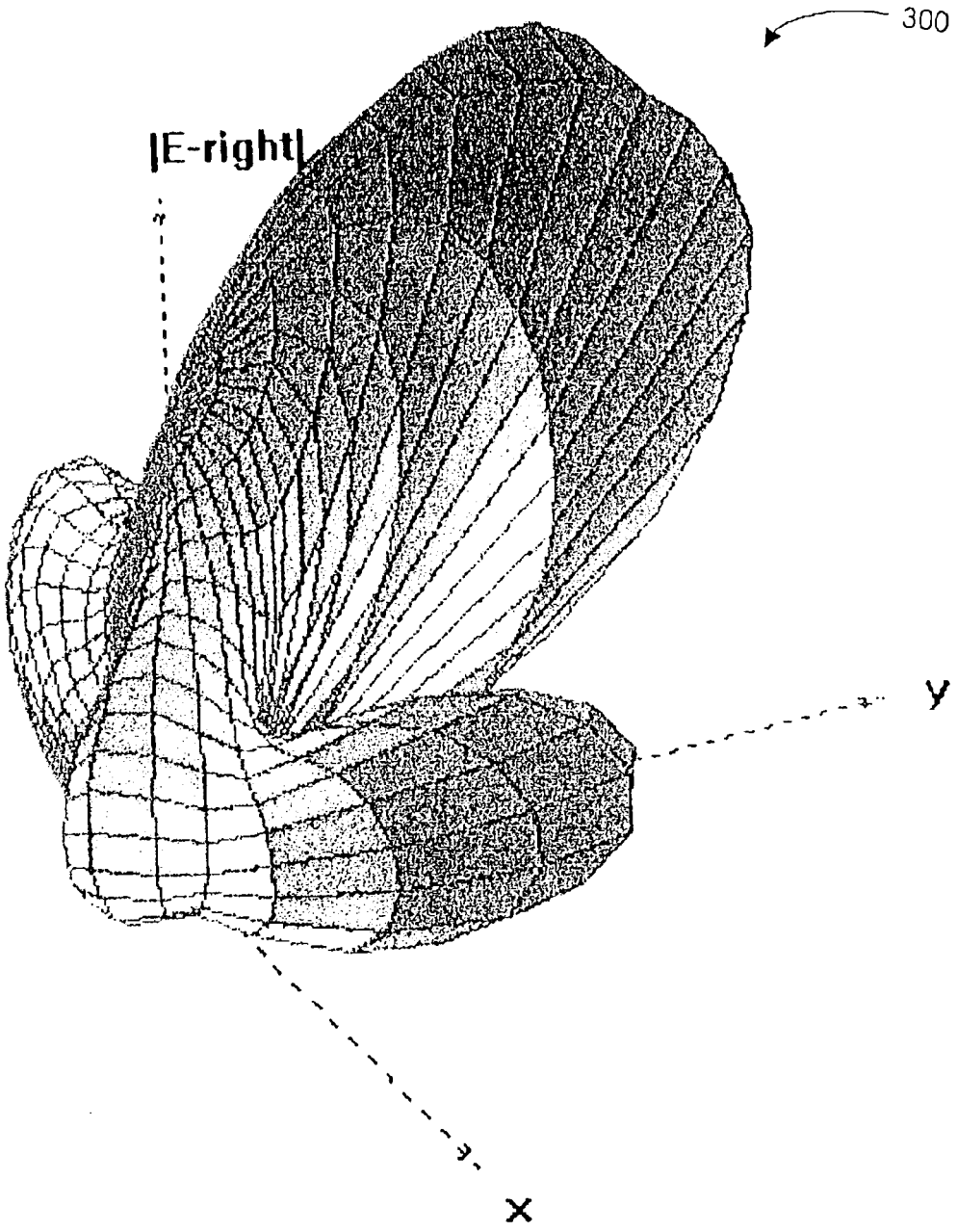
FIG. 3 shows a radiation pattern of the elongated spiral antenna of FIG. 1.
Figure 4:
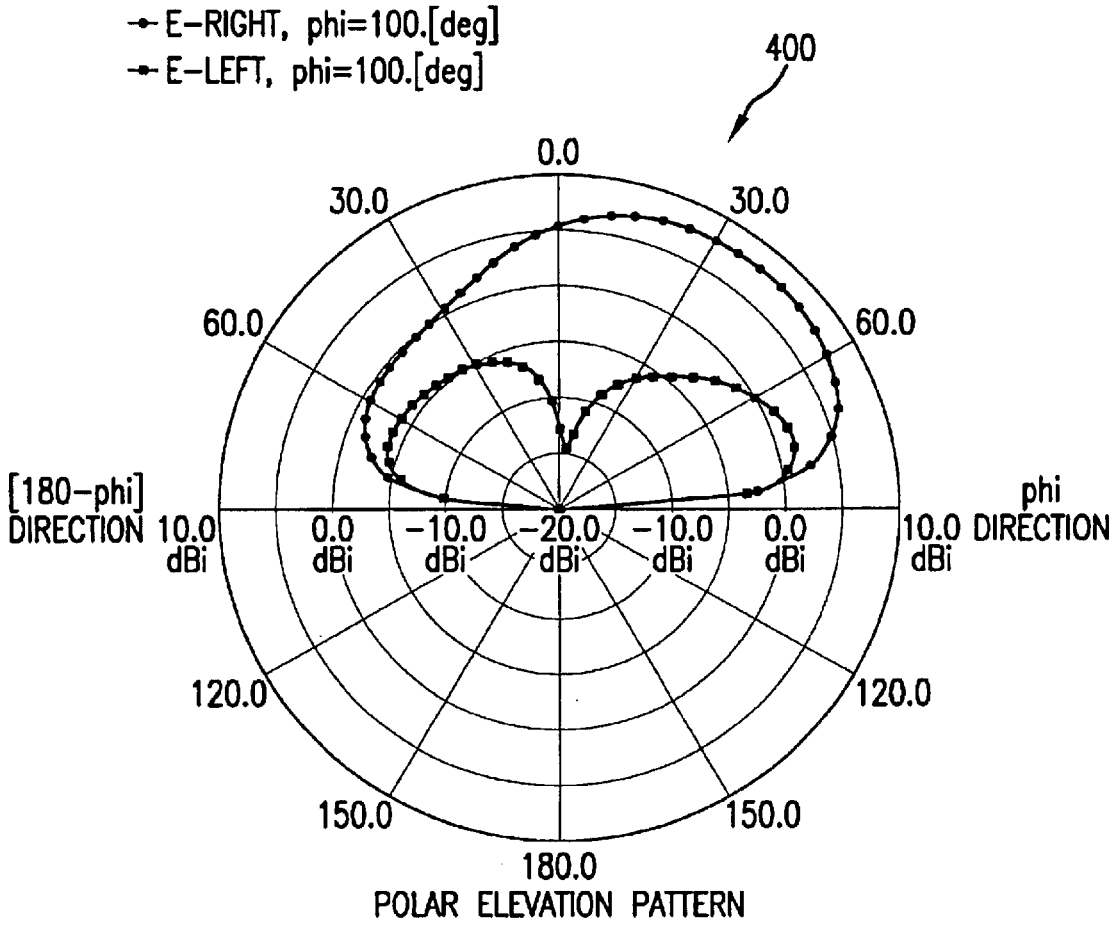
FIG. 4 shows a polar elevation pattern of the elongated spiral antenna of FIG. 1.
Figure 5:
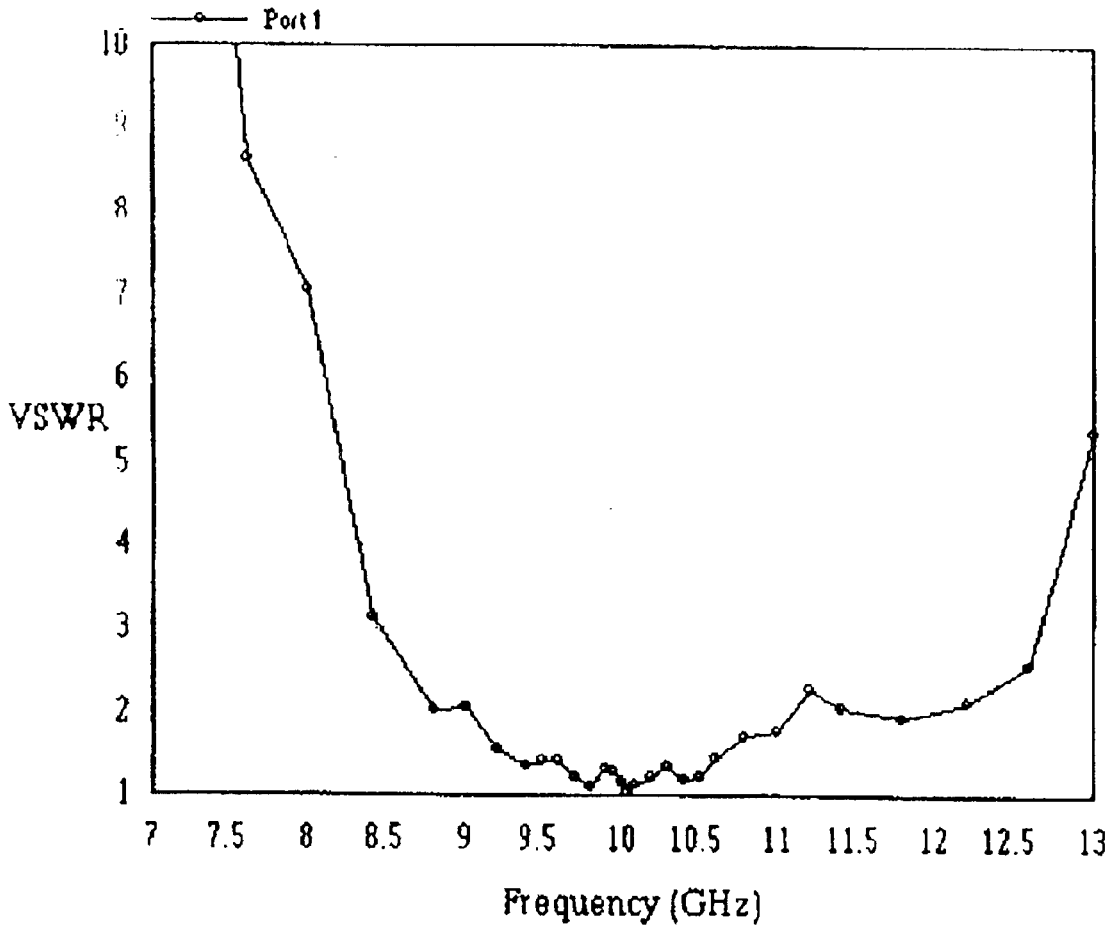
FIG. 5 shows a graph depicting a bandwidth range of the elongated spiral antenna of FIG. 1.

In operation, expanded portion 110 functions to steer a beam (e.g., control beam tilting) and control directivity of a beam. In some embodiments, directivity can be between approximately 5 dB and approximately 6 dB. This is seen in FIGS. 3 and 4, which show a radiation pattern 300 and a polar elevation pattern 400 of antenna 102. The radiation pattern 300 shows that antenna 102 is very directed because of being elongate, and has distinct nulls and minor lobes. Effectively controlling the steering and directivity allows antenna 102 to more efficiently use the transmitted beam energy. Increasing elongation in antenna 102 proportionally increases beam steering. A range of bandwidth for antenna 102 is based on an amount of turns of each arm 104, 106. The more turns, the proportionally larger the range of bandwidth (e.g., proportionally larger broadband) covered by antenna 102. For example, as seen in FIG. 5, the four turns of antenna 102 provides a bandwidth range of approximately between 7.5 GHz to approximately 13 GHz.

The shape of arms 104 and 106 is determined by the following equations:

Arm One(e.g., arm 104)$x=kx*A(\Phi)*\Phi*(\cos\Phi+K)$ $y=ky*A(\Phi)*\Phi*(\sin\Phi)$ Arm Two(e.g., arm 106)$x=kx*A(\Phi)*\Phi*(\cos\Phi-K)$ $y=ky*A(\Phi)*\Phi*(\sin\Phi)$ where:

$\Phi$ is an azimuth angle from an X axis;

A is an amplitude growth factor per radian;

K is an eccentricity constant;

kx is an x scaling factor; and ky is a y scaling factor.

A parametric plot is used to form arms 104 and 106 based on this equation by inputting varying angles. This may be done using software, hardware, or a combination of both, by entering values for known variables. In an embodiment, formation of arms 104 and 106 is done by using an apparatus (not shown) to print arms 104 and 106 on a support device (e.g., a printed circuit board) 112 based on the calculations entered into a processor in or associated with the apparatus. In other embodiments, other methods known in the art can be used to form arms 104 and 106.

In these equations, A is a function of $\Phi$ and relates to an increase in radius relative to coupler 114 for each arm 104, 106 for each turn of each arm 104, 106, for example along axis 122. Also, in these equations, eccentricity (e.g., elongation or stretching) constant K is used to cause contraction and expansion in contracting portion 108 and expanding portion 110. Thus, an amount of stretching or elongation achieved is based on K. Also, in these equations, scaling factors +/−kx and +/−ky relate to a frequency of a beam, which allow for easy re-calculation to form an antenna 102 for various operating frequencies. In other words, a size of antenna 102 is proportionally and easily scaled to adjust for various operating frequencies by simply changing scaling factors +/−kx and +/−ky. Further, in these equations, amplitude growth factor A determines how much each arm 104 and 106 grows after each turn.

In one embodiment, using four turns starting at $\pi/4$, with A=0.92, K=0.7, kx=1.3, ky=0.85, a length of antenna 102 along the X-axis is 61 (millimeters) mm and a height of antenna 102 along the Y-axis is 40 mm. Also, a width of each arm 104 and 106 is approximately 0.6 mm. Accordingly, these factors produce antenna 102 operating in the bandwidth range as described above.

In some embodiments, a switching device (e.g., a pin diode, or the like) can be positioned on coupler 114 or elsewhere in system 100. The switching device can electronically switch excitation of first and second arms 104 and 106 to control receipt of a beam from a specific direction or and transmission of a beam in a specific direction. Thus, antenna 102 can accurately receive and transmit beams without requiring any mechanical and/or manual movement of arms 104 and/or 106.

Figure 6:
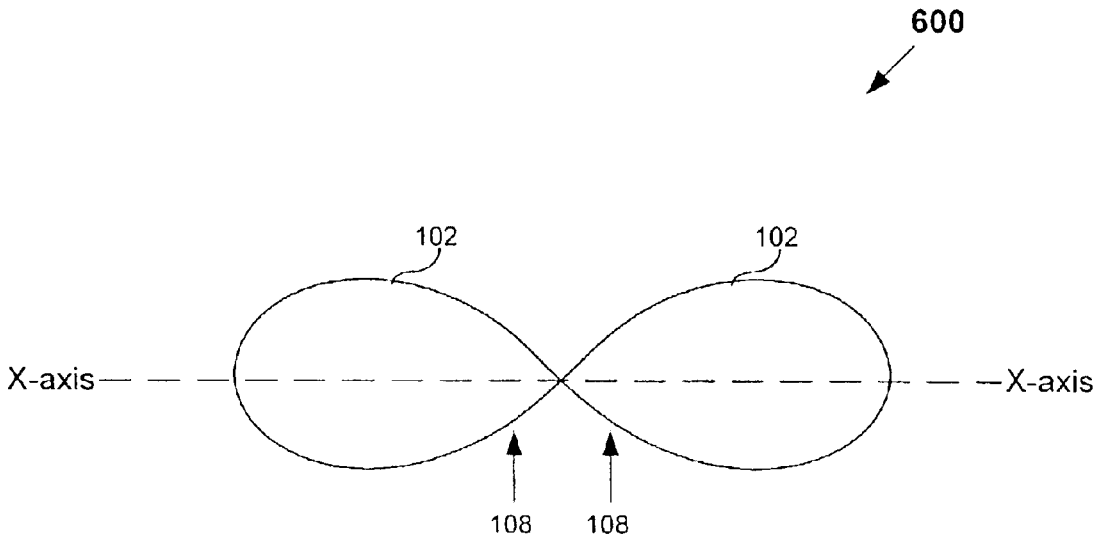
FIGS. 6–8 show various arrangements of antennas according to various embodiments of the present invention.
Figure 7:
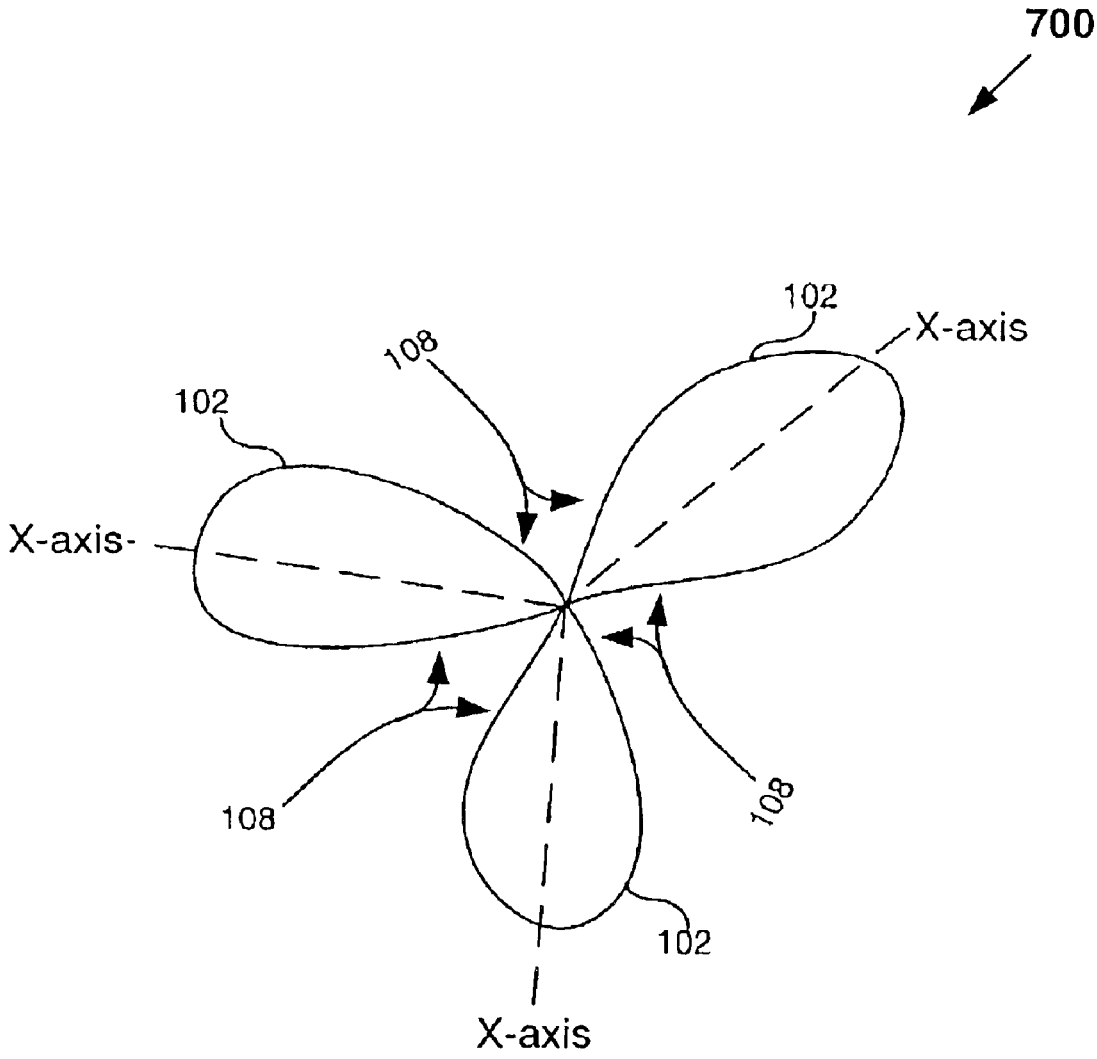
Figure 8:
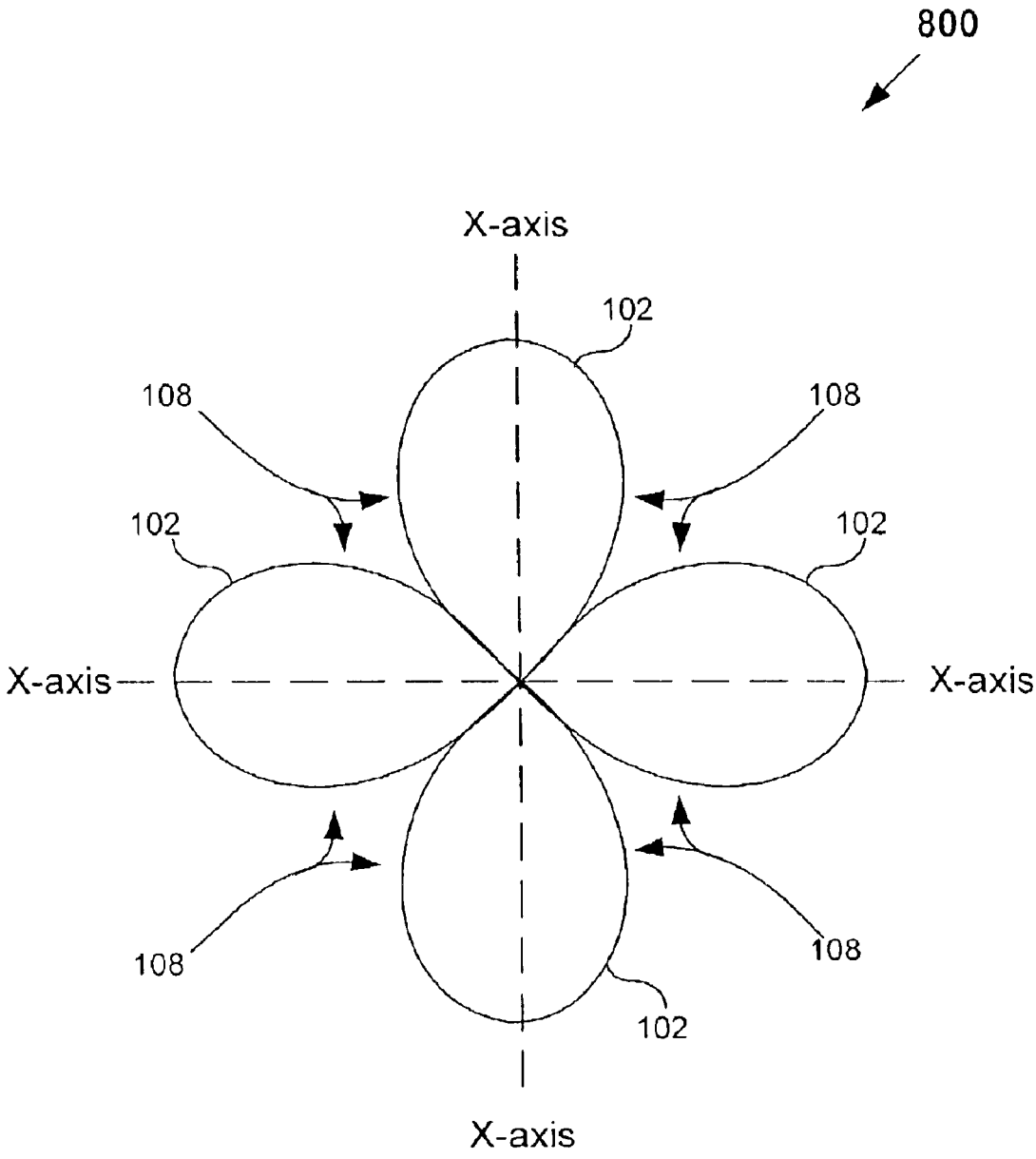

FIGS. 6–8 show various arrangements of antenna 102 that can be used to transmit and receive beams in varying directions according to embodiments of the present invention. In most embodiments, these arrays of antennas 102 are printed on circuit board 112, which is cost effective. Only an outline of antenna 102 is shown for convenience. In the embodiment shown in FIG. 6, a system 600 includes two antennas 102 that are positioned so that contracted portions 108 are proximate each other and their X-axes are positing along a same line. In the embodiment shown in FIG. 7, a system 700 includes three antennas 102 that are positioned so that contracted portions 108 are proximate each other and their X-axes are relatively 120° apart. In the embodiment shown in FIG. 8, a system 800 includes four antennas 104 that are positioned so that contracted portions 108 are proximate each other and their X-axes are relatively 90° apart. Each of these configurations will yield different fields of transmission and reception of beams, based on varying requirements of systems 600, 700, and/or 800. In some embodiments, an azimuth beamwidth can be 360° and elevational beamwidth can be 180°. Thus, combing the ability to form printed arrays of antennas 102 on a circuit board and the overall size of the arrays being in the mm range, a cost effective antenna system (e.g., 600, 700, or 800) can be incorporated into increasingly smaller devices (e.g., handheld, mobile, and/or wireless communication devices) that still cover an entire field of reception and transmission.

All the functions, arrangements, and variations discussed above for elongated spiral antenna 102 can be applied to tall elongated spiral antenna 900 and round elongated spiral antenna 1300 discussed below.

Tall Elongated Spiral Antenna

Figure 9:
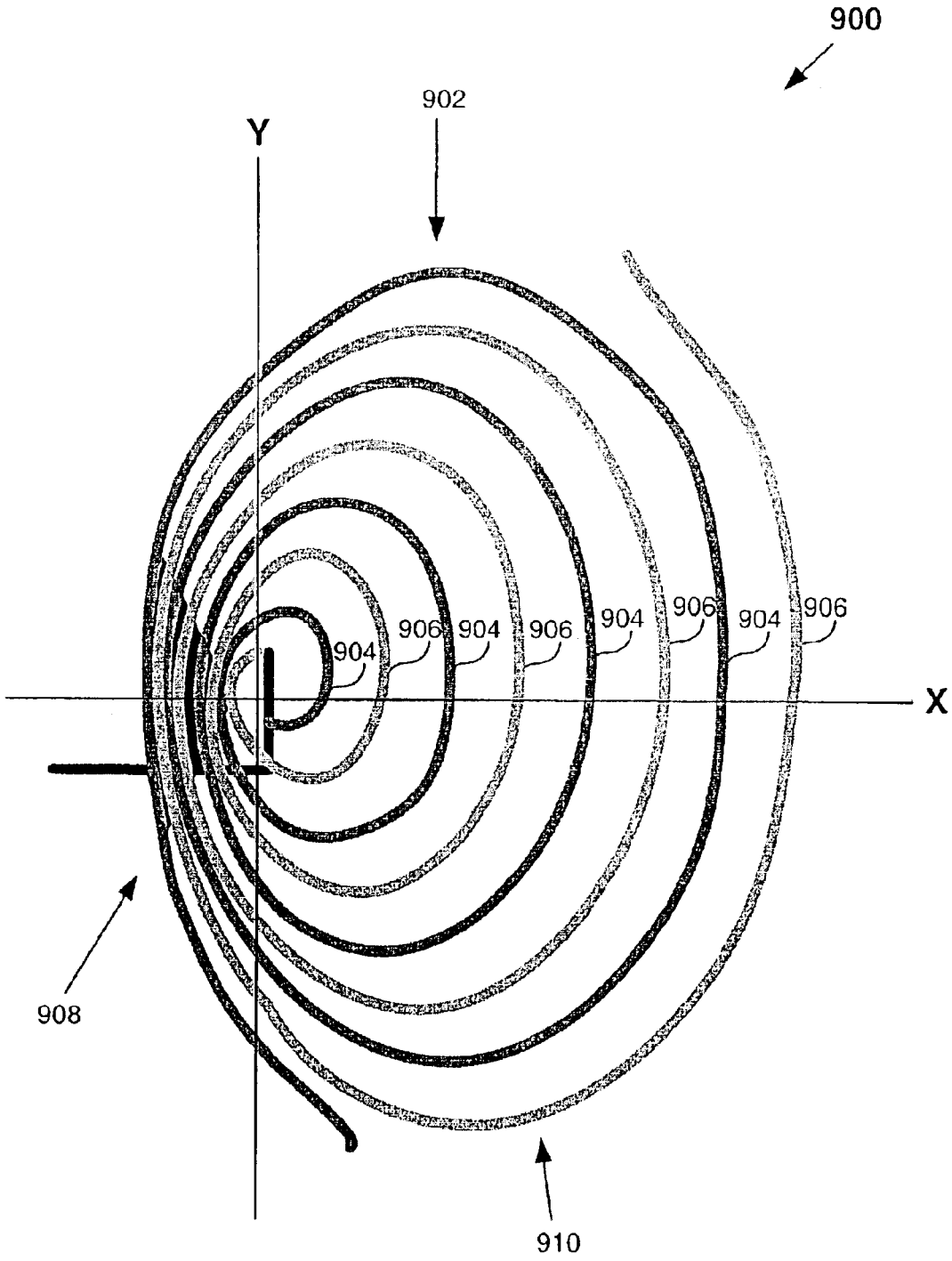
FIG. 9 shows a tall elongated spiral antenna according to embodiments of the present invention.

FIG. 9 shows a system 900 that includes a tall elongated spiral antenna 902 according to embodiments of the present invention. Tall refers to antenna 902 being more elongated along a Y-axis. Antenna 902 includes first 904 and second 906 arms. Again, it is to be appreciated, more or fewer arms can be used without departing from the scope of the invention. In the example shown, each arm 904, 906 has four turns, which form a contracted portion 908 and an expanded portion 910 of antenna 902.

Figure 10:
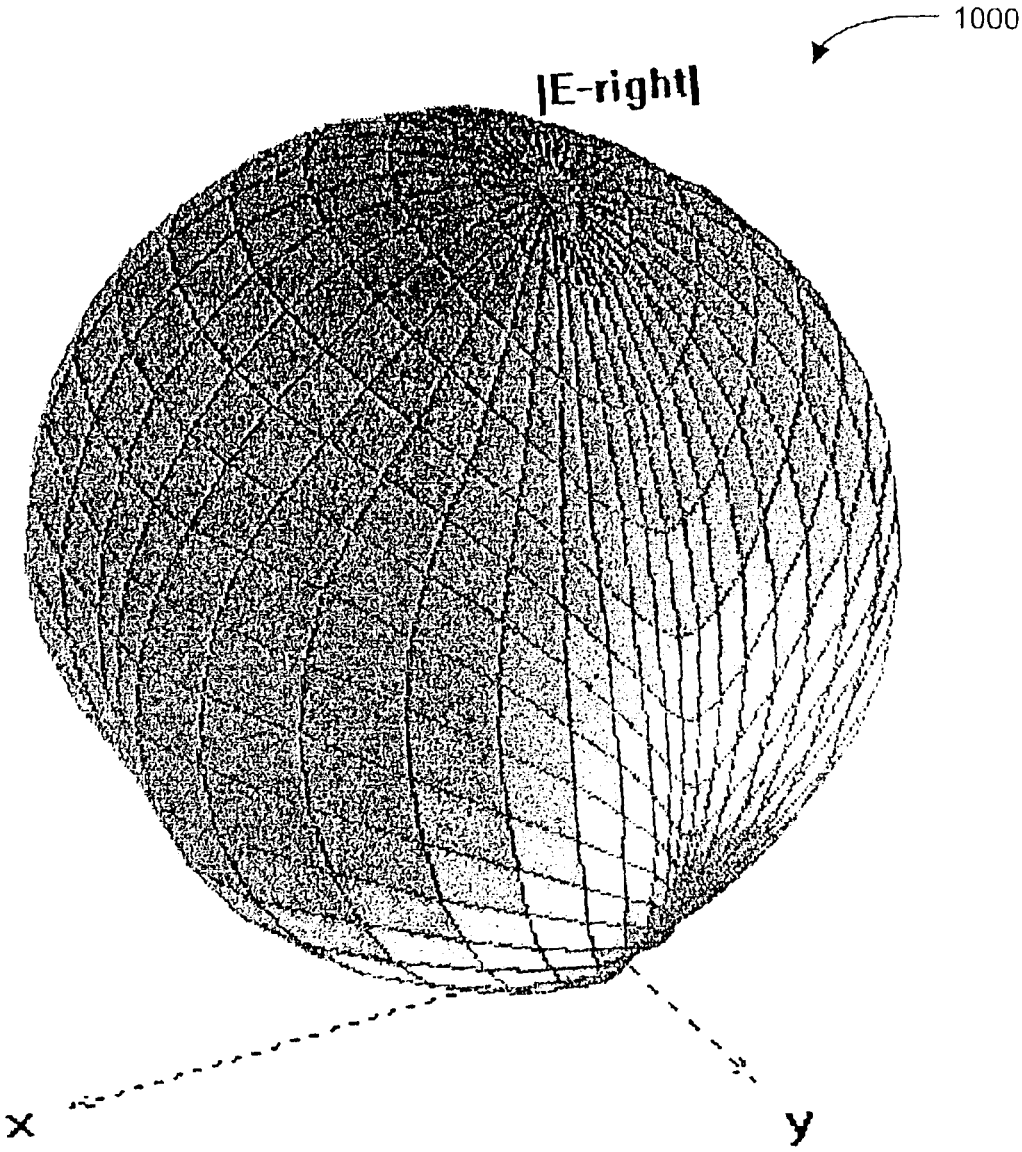
FIG. 10 shows a radiation pattern of the tall elongated spiral antenna of FIG. 9.
Figure 11:
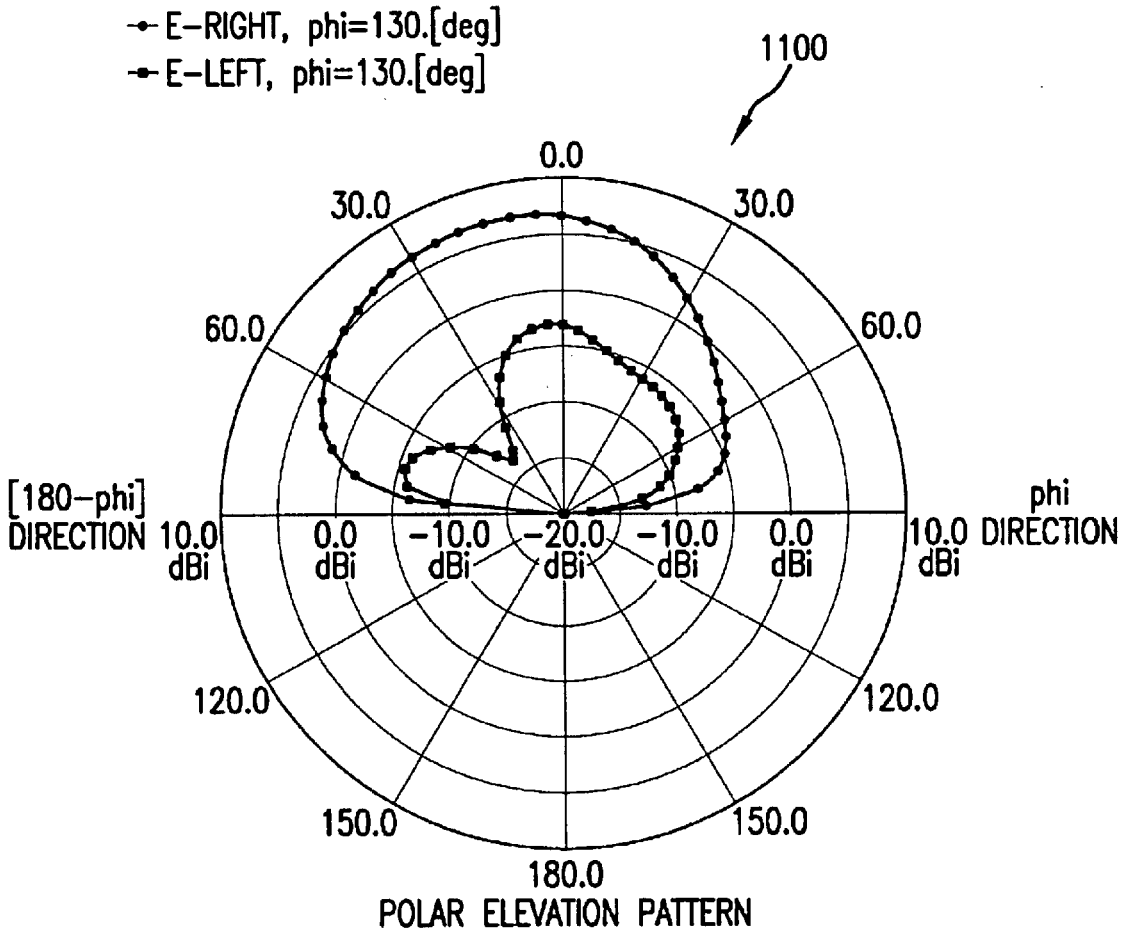
FIG. 11 shows a polar elevation pattern of the tall elongated spiral antenna of FIG. 9.
Figure 12:
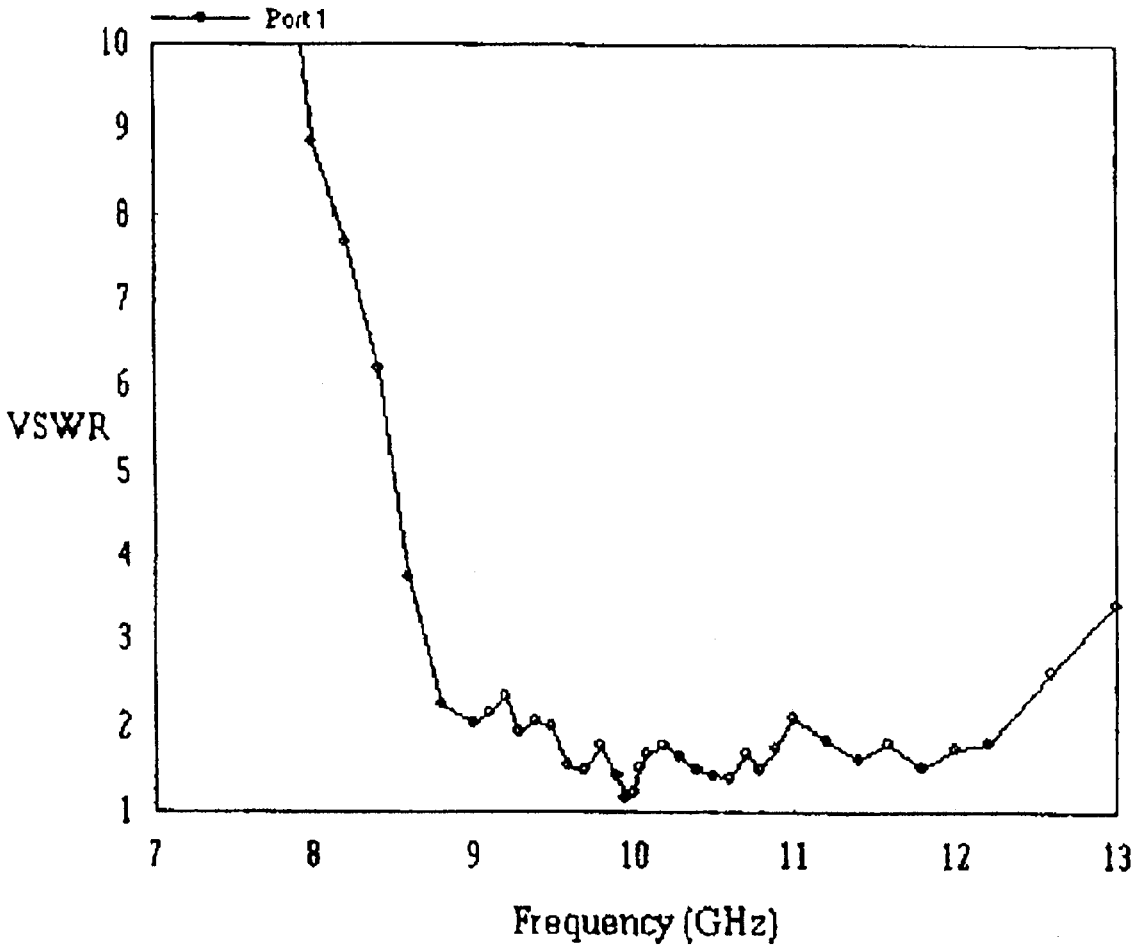
FIG. 12 shows a graph depicting a bandwidth range of the tall elongated spiral antenna of FIG. 9.

In operation, expanded portion 910 functions to steer a beam and control directivity of a beam. This is seen in FIGS. 10 and 11, which show a radiation pattern 1000 and a polar elevation pattern 1100 of antenna 902. As compared to radiation pattern 300 of antenna 102, the radiation pattern 1000 of antenna 902 is more spherical. A bandwidth range for antenna 902 is based on an amount of turns of each arm 904, 906. The more turns, the larger a range of bandwidth. For example, as seen in FIG. 12, the four turns of antenna 902 provides a bandwidth range of approximately between 8 GHz to approximately 13 GHz.

In one embodiment, using four turns starting at $\pi/4$, with A=0.92, K=0.7, kx=0.85, ky=1.2, a length of antenna 902 along the X-axis is 40 (millimeters) mm and a height of antenna 902 along the Y-axis is 55 mm. Also, a width of each arm 904 and 906 is approximately 0.575 mm. According, these factors produce antenna 902 operating in the bandwidth range as described above.

Round Elongated Spiral Antenna

Figure 13:
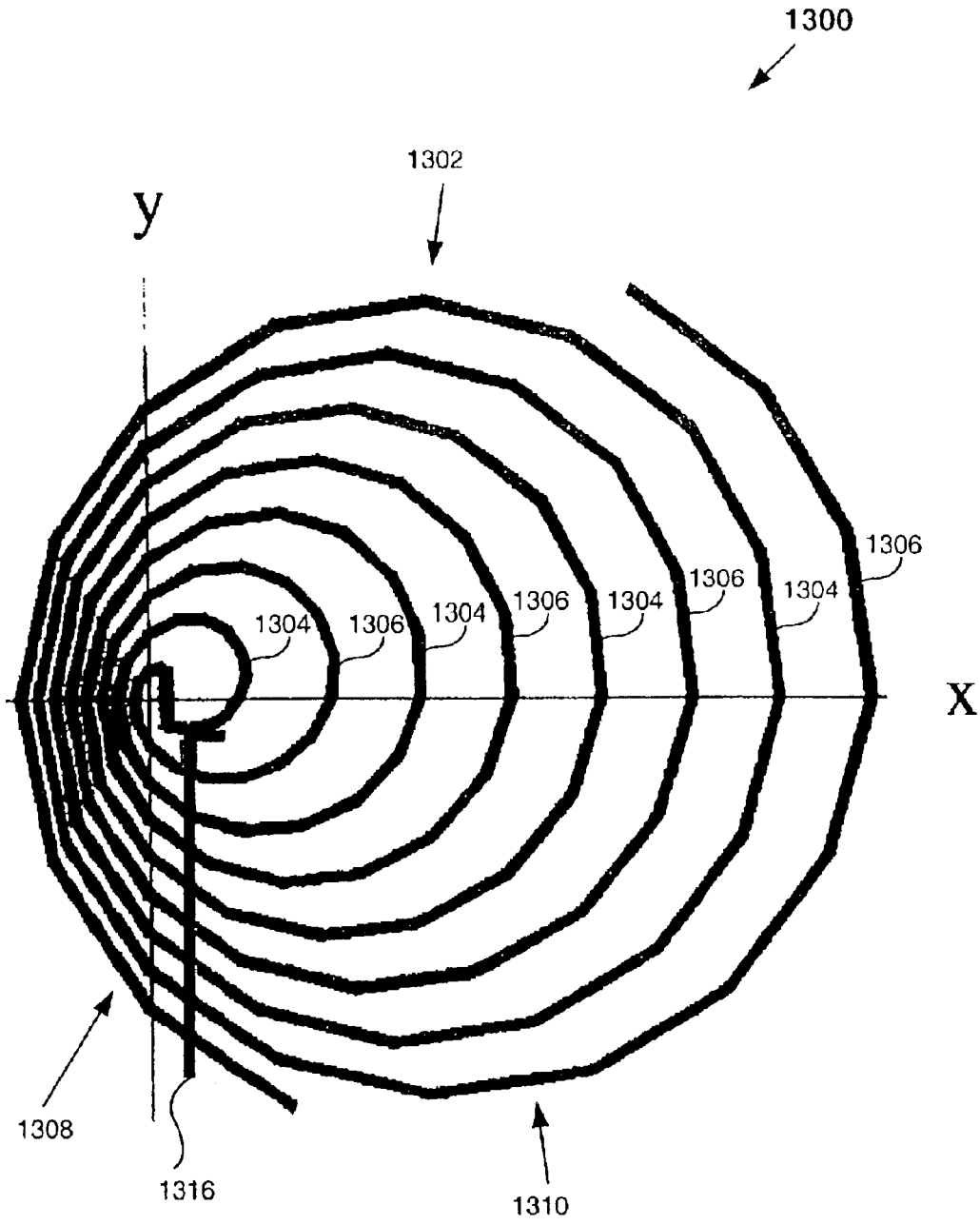
FIG. 13 shows a round elongated spiral antenna according to embodiments of the present invention.

FIG. 13 shows a system 1300 that includes a round elongated spiral antenna 1302 according to embodiments of the present invention. Round refers to antenna 1302 being equally elongated along an X-axis and a Y-axis. Antenna 1302 includes first 1304 and second 1306 arms. Again, it is to be appreciated, more or fewer arms can be used without departing from the scope of the invention. In the example shown, each arm 1304, 1306 has four turns, which form a contracted portion 1308 and an expanded portion 1310 of antenna 1302.

Figure 14:
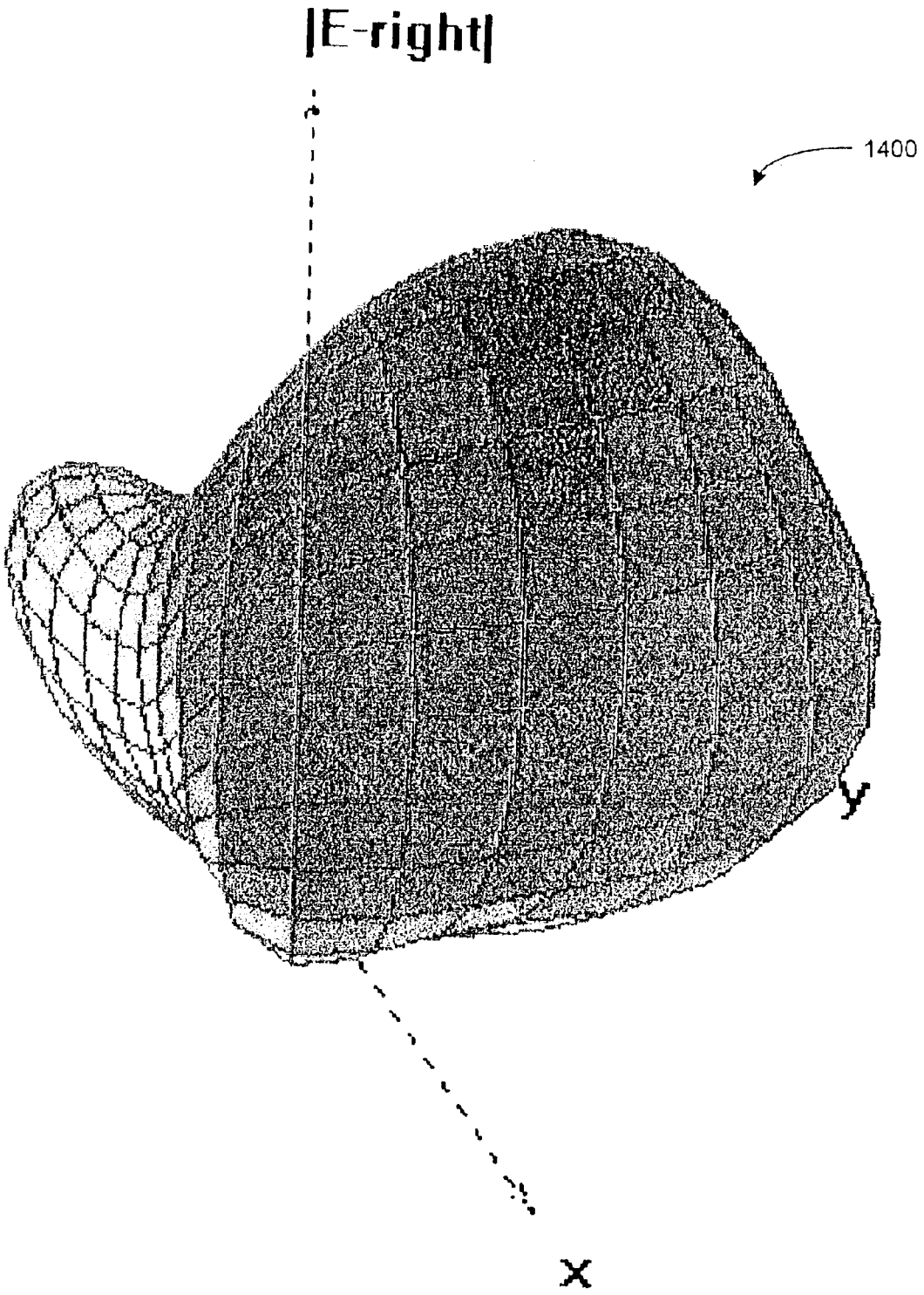
FIG. 14 shows a radiation pattern of the round elongated spiral antenna of FIG. 13.
Figure 15:
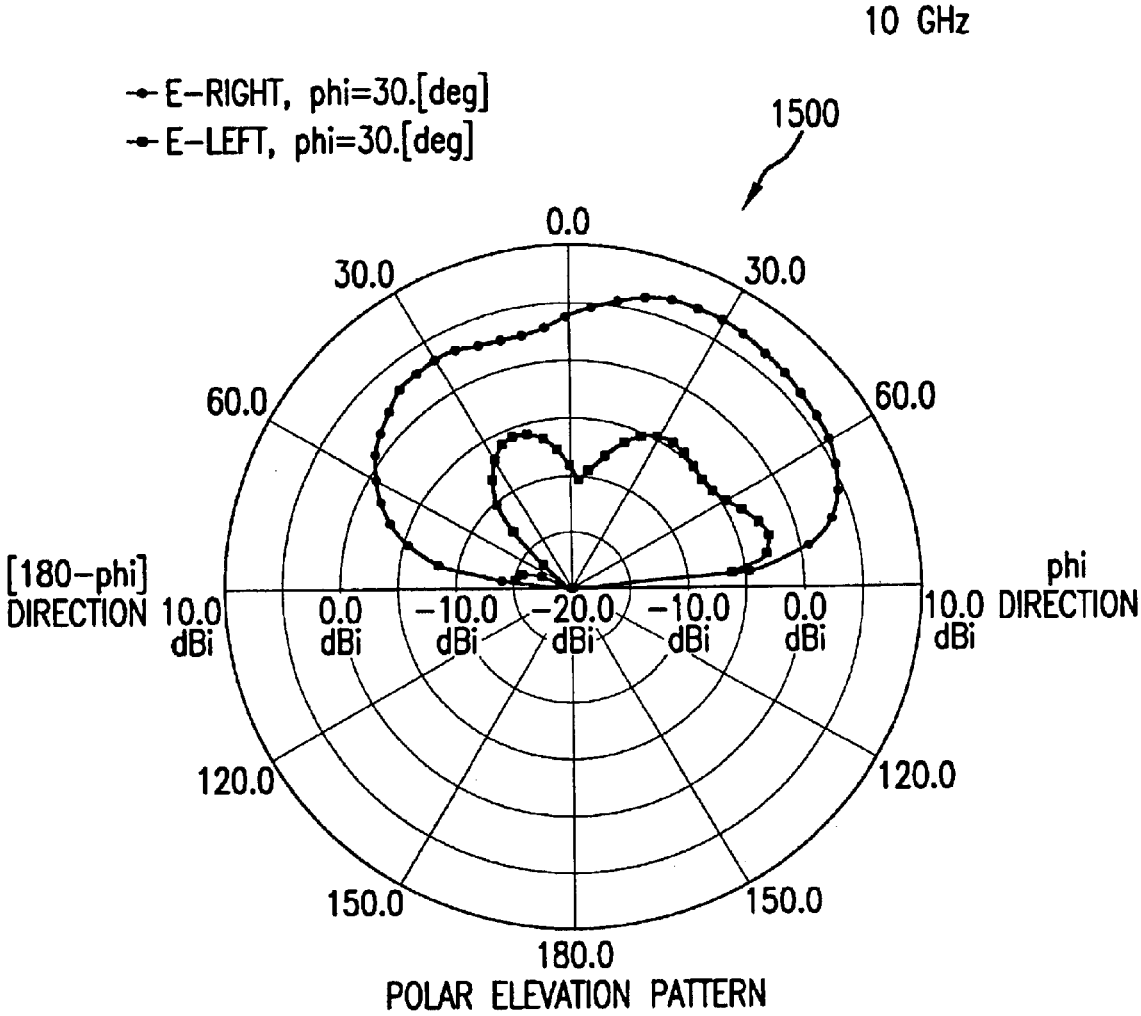
FIG. 15 shows a polar elevation pattern of the round elongated spiral antenna of FIG. 13.
Figure 16:
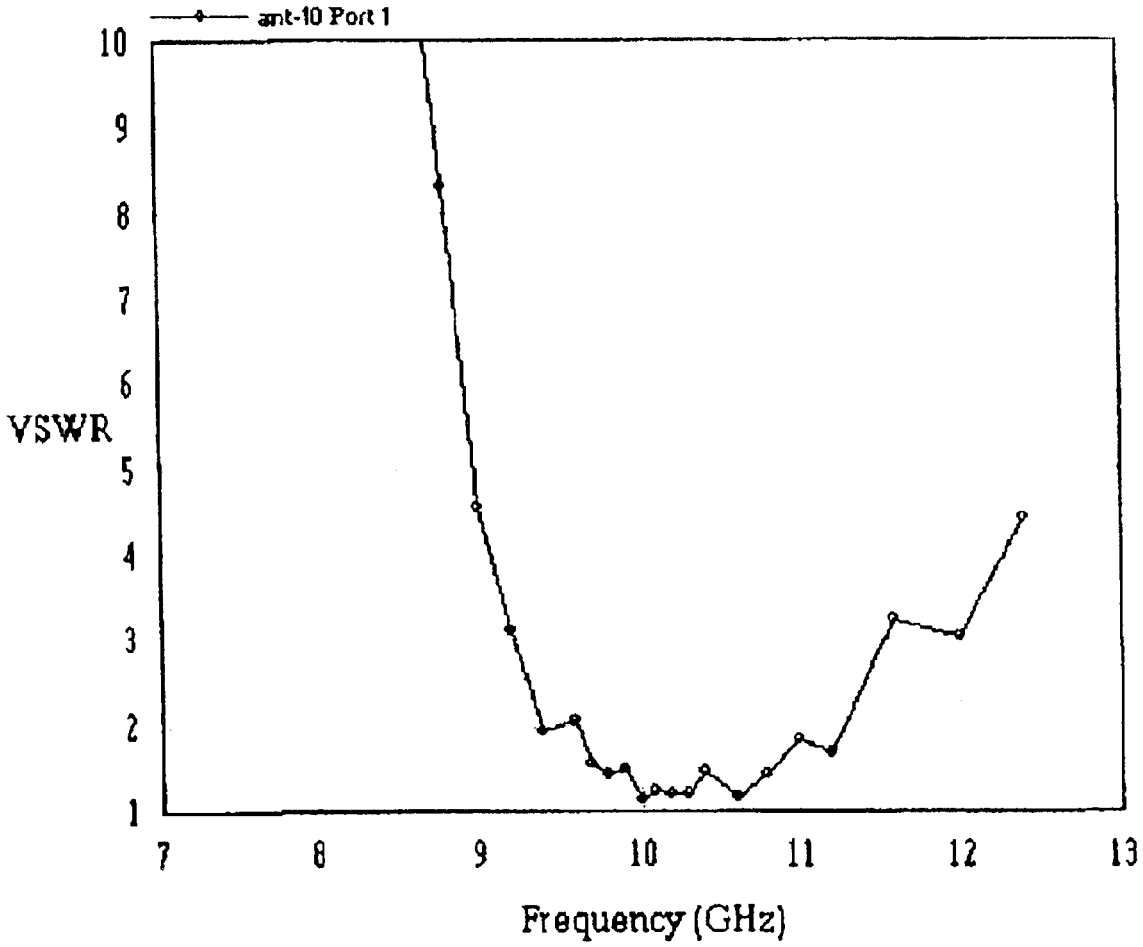
FIG. 16 shows a graph depicting a bandwidth range of the round elongated spiral antenna of FIG. 13.

In operation, expanded portion 1310 functions to steer a beam and control directivity of a beam. This is seen in FIGS. 14 and 15, which show a radiation pattern 1400 and a polar elevation pattern 1500 of antenna 1302. As compared to antenna 902, antenna 1302 is more directed, but has no distinct nulls or minor lobes as found in the radiation pattern 300 for antenna 102. A bandwidth range for antenna 1302 is based on an amount of turns of each arm 1304, 1306. The more turns, the larger a range of bandwidth. For example, as seen in FIG. 16, the four turns of antenna 1302 provides a bandwidth range of approximately between 9 GHz to approximately 12.5 GHz.

In one embodiment, using four turns starting at $\pi/4$, with A=0.9, K=0.7, kx=1, ky=1, a length of antenna 1302 along the X-axis is 45 (millimeters) mm and a height of antenna 1302 along the Y-axis is 45 mm. Also, a width of each arm 1304 and 1306 is approximately 0.5 mm. According, these factors produce antenna 1302 operating in the bandwidth range as described above.

Substrate Configuration

Figure 17:
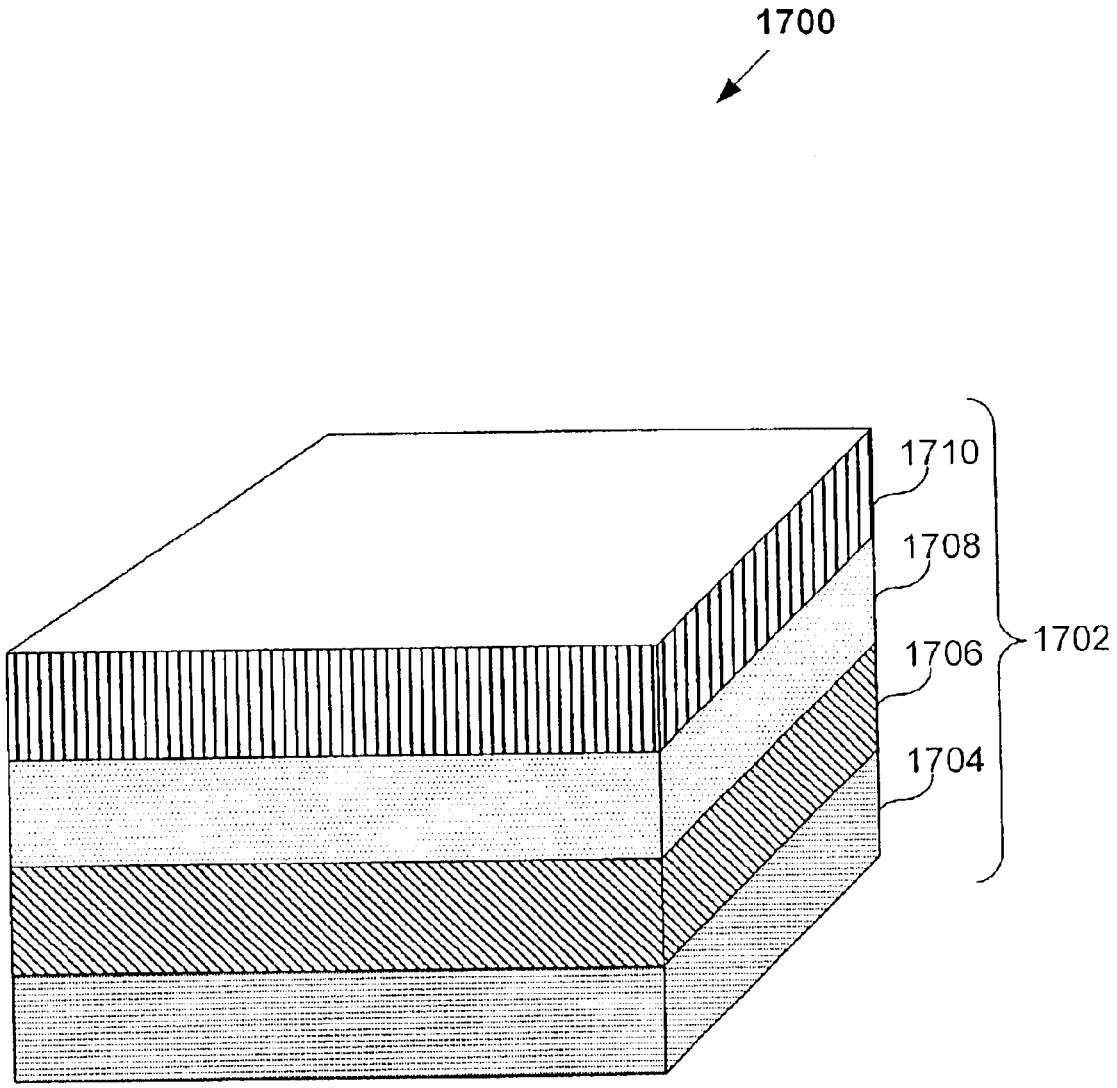
FIG. 17 is a cross sectional view of a portion of a system that has an elongated spiral antenna according to embodiments of the present invention.

FIG. 17 shows a cross-sectional view of a substrate and antenna configuration 1700 according to embodiments of the present invention. Substrate thickness, either overall or individual layers, can be calculated based on a frequency of a beam being received or transmitted. In this embodiment, first and second spirals of the antennas discussed above are printed on a multi-layer microwave substrate 1702. In one embodiment, a first layer 1704 can be a grounded dielectric layer, which can include a microstrip feed line and tuning elements printed thereon. First layer 1704 can be approximately 0.33 mm thick and can have a dielectric constant of approximately $\in$=6.0. A second layer 1706 can include a parasitic coupling dipole printed thereon. For example, first section 114A of coupler 114 and feed line 116 can be printed on second layer 1706. Second layer 1706 can be approximately 0.2 mm thick and can have a dielectric constant of approximately $\in$=6.0. A third layer 1708 can include antenna spirals printed thereon. For example, second section 114B of coupler 114 and an antenna (e.g., antenna 102, or the other variations of antennas described above) can be printed on third layer 1708. Third layer 1708 can be approximately 0.5 mm thick and can have a dielectric constant of approximately $\in$=6.0. A fourth layer 1710 can be a cover layer. Fourth layer 1710 can be approximately 0.2 mm thick and can have a dielectric constant of approximately 3.0. Thus, substrate 1702 can be 1.2 mm thick in total. It is to be appreciated that thickness can be inversely proportional to frequency, where doubling the frequency requires half the total thickness. An input signal is electro-magnetically coupled from second layer 1706 to third layer 1708.

Methodology of Forming an Elongated Spiral Antenna

Figure 18:
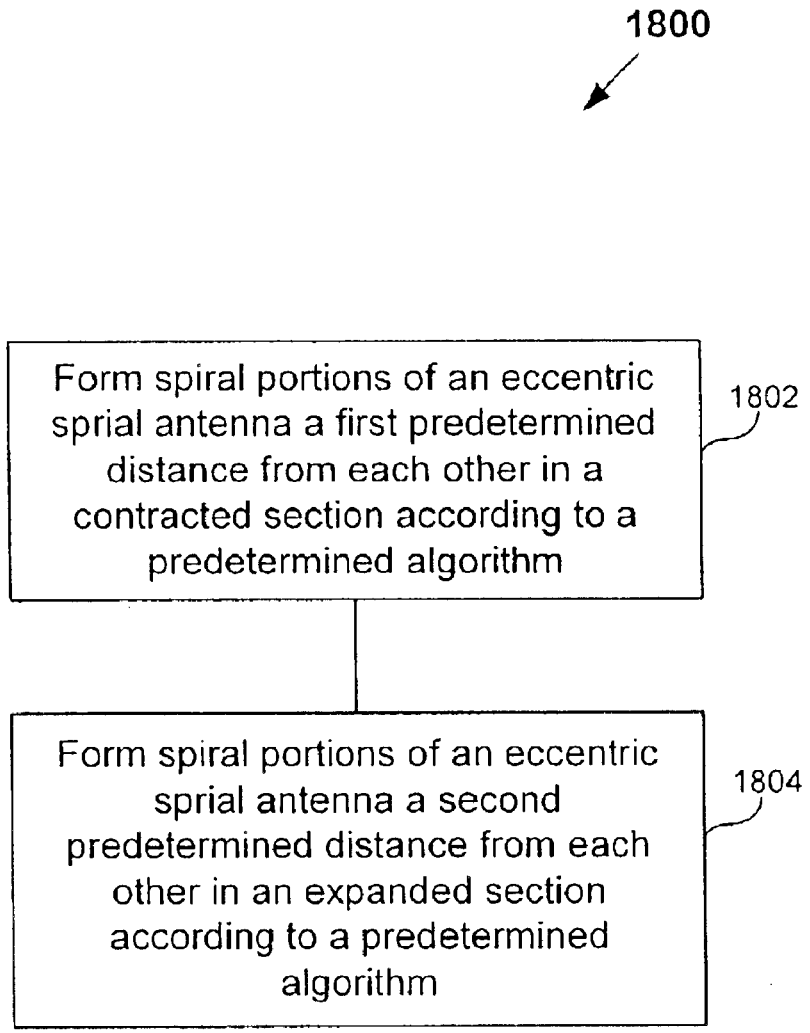
FIG. 18 is a flow chart depicting a method for forming an elongated spiral antenna according to embodiments of the present invention.

FIG. 18 is a flowchart depicting a method 1800 for forming an elongated spiral antenna according to embodiments of the present invention. At step 1802, spiral portions of an elongated spiral antenna are formed a first predetermined distance from each other in a contracted section based on a predetermined algorithm. At step 1804, the spiral portions of the elongated spiral antenna are spaced a second predetermined distance from each other in an expanded section based on a predetermined algorithm. The first predetermined distance is less than and can be proportional to the second predetermined distance, such that beam steering and directivity are based on the spacing of the second predetermined distance. Preferably, the algorithm discussed above can be used.

System Using an Elongated Antenna

Figure 19:
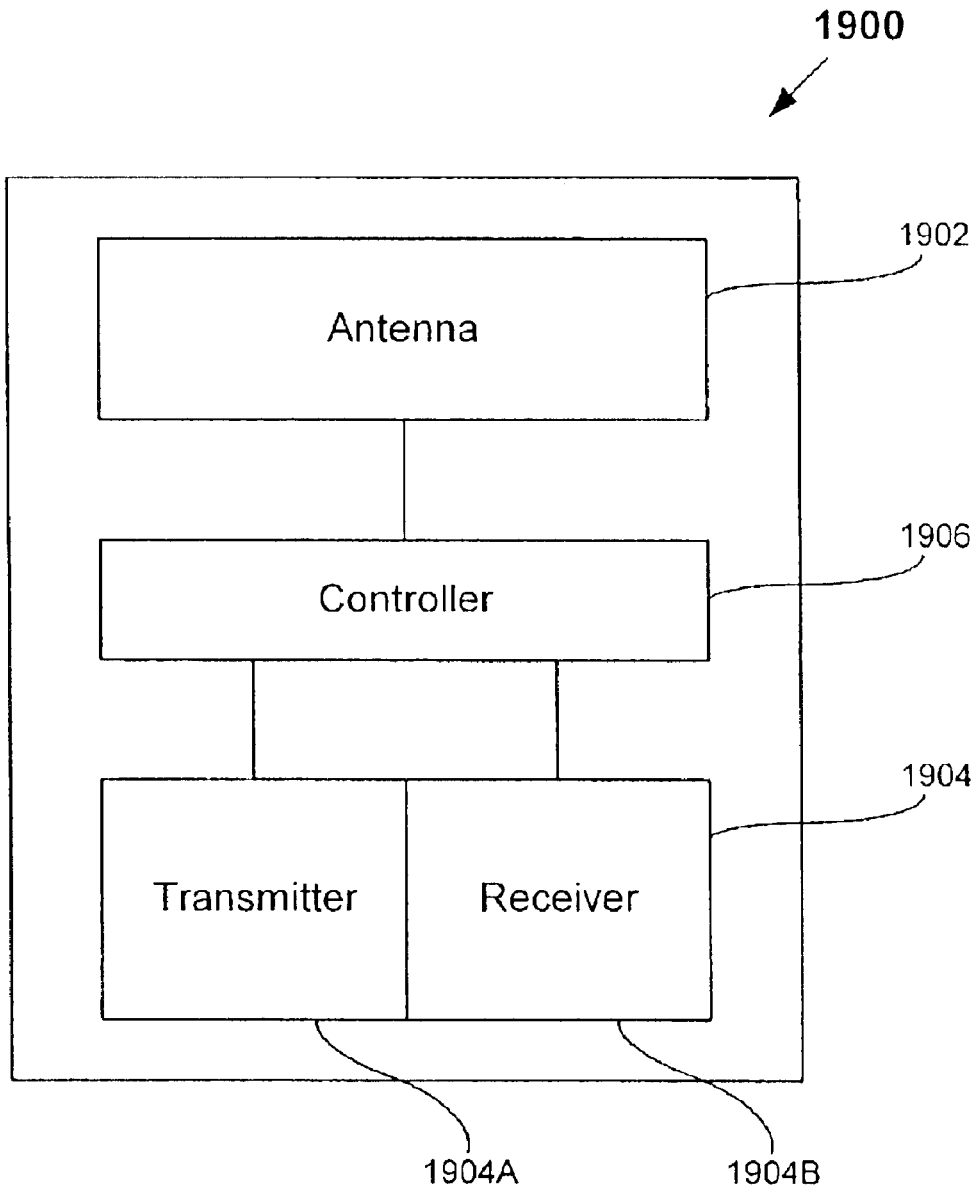
FIG. 19 shows a system that uses an elongated antenna according to embodiments of the present invention.

FIG. 19 shows a device 1900 using an elongated antenna 1902 according to embodiments of the present invention. Device 1900 can be any handheld, mobile, and/or wireless communications device. Antenna 1902 can include any of the above described elongated antennas, or other elongated antennas developed in the future. Antenna 1902 is coupled to a transceiver 1904 via a controller 1906. Transceiver 1904 includes a transmitter section 1904A and a receiver section 1904B. In other embodiments, a separate transmitter and receiver can be used in place of transceiver 1904. Controller 1906 controls transmission and reception of beams, and other aspects of antenna 1902 as described above or otherwise known in the art.

CONCLUSION

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. A system comprising:

a support device; and an elongated spiral antenna coupled to the support device, the elongated spiral antenna including at least two arms, one end of each of the arms being coupled to a same feed line, the two arms forming a contracted side and an expanded side of the elongated spiral antenna, the expanded side providing beam steering and directivity.

2. The system of claim 1, wherein the elongated spiral antenna is printed on the support device.

3. The system of claim 1, wherein the support device is a circuit board.

4. The system of claim 1, wherein the elongated spiral antenna is a round elongated spiral antenna.

5. The system of claim 1, wherein the elongated spiral antenna is a tall elongated spiral antenna.

6. The system of claim 1, wherein the elongated spiral antenna is an expanded spiral antenna.

7. The system of claim 1, wherein the elongated spiral antenna is substantially elongated along a Y-axis.

8. The system of claim 1, wherein the elongated spiral antenna is substantially elongated along an X-axis.

9. The system of claim 1, wherein each one of the at least two arms includes a predetermined number of turns.

10. The system of claim 9, wherein the predetermined number of turns is based on a predetermined bandwidth range.

11. The system of claim 1, wherein each one of the at least two arms includes four turns.

12. The system of claim 1, wherein pairs of the at least two arms are shaped according to:

Arm One $x=kx*A*\Phi*(\cos \Phi+K)$ $y=ky*A*\Phi*(\sin \Phi)$

Arm Two $x=kx*A*\Phi*(\cos \Phi-K)$ $y=ky*A*\Phi*(\sin \Phi)$ wherein

Φ is an azimuth angle from an X axis;

A is an amplitude growth factor per radian;

K is an eccentricity constant;

kx is an x scaling factor; and ky is a y scaling factor.

13. The system of claim 1, wherein spacing between spirals of the expanded side is greater than and proportional to spacing between spirals of the contracted side.

14. The system of claim 1, wherein a steering amount of a beam transmitted by the elongated spiral antenna is proportional to an expanded amount of the expanded side.

15. The system of claim 1, further including a switching device, wherein the elongated spiral antenna includes a plurality of spiral sections, and wherein the switching device is controlled to electrically switch to a predetermined one of the plurality of spiral sections based on a direction of a received beam.

16. The system of claim 1, further including a switching device, wherein the elongated spiral antenna includes a plurality of spiral sections, and wherein the switching device is controlled to electrically switch to a predetermined one of the plurality of spiral sections based on a direction of a transmitted beam.

17. The system of claim 1, wherein the feed line is comprised of a microstrip feed line.

18. The system of claim 1, wherein the support device, the elongated spiral antenna, and the feed line are located in a communications device.

19. The system of claim 1, further comprising a plurality of the elongated spiral antennas arranged such that the contracted side of each of the plurality of the elongated spiral antennas is proximate the contracted side of other ones of each of the plurality of the elongated spiral antennas.

20. The system of claim 19, wherein the plurality of the elongated spiral antennas comprises three of the elongated spiral antennas spaced 120° relative to each respective X-axis.

21. The system of claim 19, wherein the plurality of the elongated spiral antennas comprises four of the elongated spiral antennas spaced 90° relative to each respective X-axis.

22. The system of claim 19, wherein the support device, the plurality of the elongated spiral antennas, and the feed line are located in a communications device.

23. The system of claim 1, wherein the directivity of the elongated spiral antenna is between approximately 5 dB to 5 dB.

24. An elongated spiral antenna comprising:

a feed line;

a first spiral portion coupled to the feed line; and a second spiral portion coupled to the feed line, each of the first and second spiral portions being spaced from each other to form a contracted side and an expanded side, the expanded side being used during beam steering and directivity.

25. The elongated spiral antenna of claim 24, wherein the spacing of the first and second spiral portions from each other in the contracted side is less than and proportional to the spacing of the first and second spiral portions from each other in the expanded side.

26. The elongated spiral antenna of claim 24, wherein a steering amount of a transmitted beam is proportional to an expanded amount of the expanded side.

27. The elongated spiral antenna of claim 24, wherein each of the first and second spiral portions have a predetermined number of turns based on a predetermined bandwidth range.

28. The elongated spiral antenna of claim 24, wherein the first and second spiral portions are shaped according to:

First Spiral Portion $x=kx*A*\Phi*(\cos \Phi+K)$ $y=ky*A*\Phi*(\sin \Phi)$

Second Spiral Portion $x=kx*A*\Phi*(\cos \Phi-K)$ $y=ky*A*\Phi*(\sin \Phi)$ wherein Φ is an azimuth angle from an X axis;

A is an amplitude growth factor per radian;

K is an eccentricity constant;

kx is an x scaling factor; and ky is a y scaling factor.

29. The elongated spiral antenna of claim 24, wherein the feed line and the first and second spiral portions are formed on a support surface.

30. The elongated spiral antenna of claim 24, wherein the feed line and the first and second spiral portions are printed on a circuit board.

31. A communications device comprising:

a transmitter;

a receiver; and an elongated spiral antenna, said elongated spiral antenna including:

a feed line;

a first spiral portion coupled to the feed line; and a second spiral portion coupled to the feed line, each of the first and second spiral portions being spaced from each other and forming a contracted side of the elongated spiral antenna and an expanded side of the elongated spiral antenna, the expanded side being used during beam steering and directivity.

32. A method comprising:

coupling an end of first and second spiral portions of an elongated spiral antenna to a feed line;

spacing the spiral portions a first predetermined distance from each other in a contracted side; and spacing the spiral portions a second predetermined distance from each other in an expanded side, the first predetermined distance being less than and proportional to the second predetermined distance, such that beam steering and directivity are based on the spacing of the second predetermined distance.

33. The method of claim 32, further comprising the step of forming the spiral portions on a support surface.

34. The method of claim 33, wherein the forming step comprises printing.

35. The method of claim 34, further comprising the step of securing the support surface in a communications device.

36. The method of claim 32, further comprising the step of printing the spiral portions on a circuit board.

37. The method of claim 36, further comprising the step of securing the circuit board in a communications device.

38. The method of claim 32, further comprising the step of setting a bandwidth range of the elongated spiral antenna based a number of turns in the spiral portions.

39. The method of claim 32, further comprising the step of shaping pairs of the spiral portions shaped according to:

First Spiral Portion $x=kx*A*\Phi*(\cos \Phi+K)$ $y=ky*A*\Phi*(\sin \Phi)$

Second Spiral Portion $x=kx*A*\Phi*(\cos \Phi-K)$ $y=ky*A*\Phi*(\sin \Phi)$ wherein Φ is an azimuth angle from an X axis;

A is an amplitude growth factor per radian;

K is an eccentricity constant;

kx is an x scaling factor; and ky is a y scaling factor.

40. An elongated spiral antenna, comprising:

a first spiral portion; and a second spiral portion, the first and second spiral portions forming a contracted section and an expanded section, wherein the first and second spiral portions are shaped according to:

Portion One $x=kx*A*\Phi*(\cos \Phi+K)$ $y=ky*A*\Phi*(\sin \Phi)$

Portion Two $x=kx*A*\Phi*(\cos \Phi-K)$ $y=ky*A*\Phi*(\sin \Phi)$ wherein

Φ is an azimuth angle from an X axis;

A is an amplitude growth factor per radian;

K is an eccentricity constant;

kx is an x scaling factor; and ky is a y scaling factor.

41. A method, comprising:

spacing spiral portions of an elongated spiral antenna a first predetermined distance from each other in a contracted section;

spacing the spiral portions a second predetermined distance from each other in an expanded section; and shaping pairs of the spiral portions shaped according to:

First Spiral Portion $x=kx*A*\Phi*(\cos \Phi+K)$ $y=ky*A*\Phi*(\sin \Phi)$

Second Spiral Portion $x=kx*A*\Phi*(\cos \Phi-K)$ $y=ky*A*\Phi*(\sin \Phi)$ wherein Φ is an azimuth angle from an X axis;

A is an amplitude growth factor per radian;

K is an eccentricity constant;

kx is an x scaling factor; and ky is a y scaling factor.

* * * * *

UNITED STATES PATENT AND TRADEMARK OFFICE

CERTIFICATE OF CORRECTION

PATENT NO. : 6,862,004 B2
DATED : March 1, 2005
INVENTOR(S) : Alexopoulos et al.

It is certified that error appears in the above-identified patent and that said Letters Patent is hereby corrected as shown below:

Column 7,
Line 66, "5 dB" should appear as -- 6 dB --.

Signed and Sealed this

Twentieth Day of September, 2005

JON W. DUDAS
*Director of the United States Patent and Trademark Office*